US006490970B2

(12) United States Patent
Murakami

(10) Patent No.: US 6,490,970 B2
(45) Date of Patent: Dec. 10, 2002

(54) SCREEN-PRINTING APPARATUS

(75) Inventor: Takehiko Murakami, Inagi (JP)

(73) Assignee: Minami Co., Ltd., Tokyo (JP)

( * ) Notice: Subject to any disclaimer, the term of this patent is extended or adjusted under 35 U.S.C. 154(b) by 0 days.

(21) Appl. No.: 09/833,253

(22) Filed: Apr. 11, 2001

(65) Prior Publication Data

US 2001/0029851 A1 Oct. 18, 2001

(30) Foreign Application Priority Data

Apr. 14, 2000 (JP) ..... 2000-113018

(51) Int. Cl.[7] ..... B05C 17/06
(52) U.S. Cl. ..... 101/126; 101/DIG. 36
(58) Field of Search ..... 101/123, 126, 101/DIG. 36, 114, 129, 484, 485, 486

(56) References Cited

U.S. PATENT DOCUMENTS 5,176,078 A * 1/1993 Homma et al. ..... 101/126
5,730,051 A * 3/1998 Takahashi et al. ..... 101/126
5,752,446 A * 5/1998 Squibb ..... 101/126
5,901,646 A * 5/1999 Walker et al. ..... 101/123
6,036,994 A * 3/2000 Tanaka et al. ..... 101/126
6,338,297 B1 * 1/2002 Wang et al. ..... 101/126
6,347,583 B1 * 2/2002 Isogai et al. ..... 101/114
6,352,025 B1 * 3/2002 Neiconi et al. ..... 101/123
6,367,378 B1 * 4/2002 Yamazaki ..... 101/126

* cited by examiner

*Primary Examiner*—Ren Yan
(74) *Attorney, Agent, or Firm*—R. Neil Sudol; William Sapone; Henry Coleman

(57) ABSTRACT

A screen-printing apparatus with enhanced accuracy of positioning a mask to a material to be printed, in which a printing table is fixed, the mask is displaced in a right-left direction and a front-rear direction, and rotated in a horizontal plane in accordance with a position confirmation signal from a camera device and the mask, a mask support frame, a squeegee device are moved up and down together at a predetermined timing at every printing step.

4 Claims, 3 Drawing Sheets

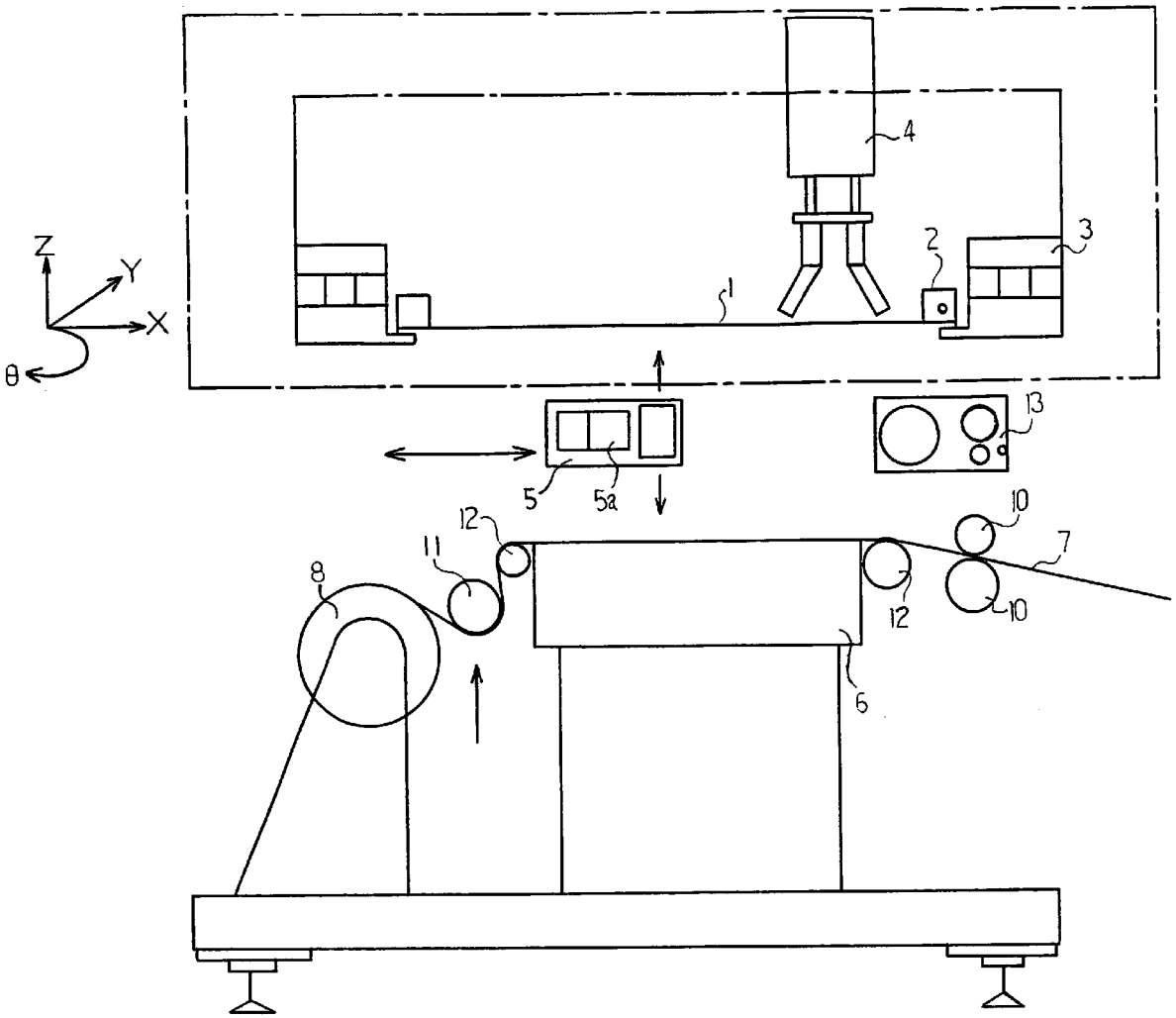
[Fig. 1]

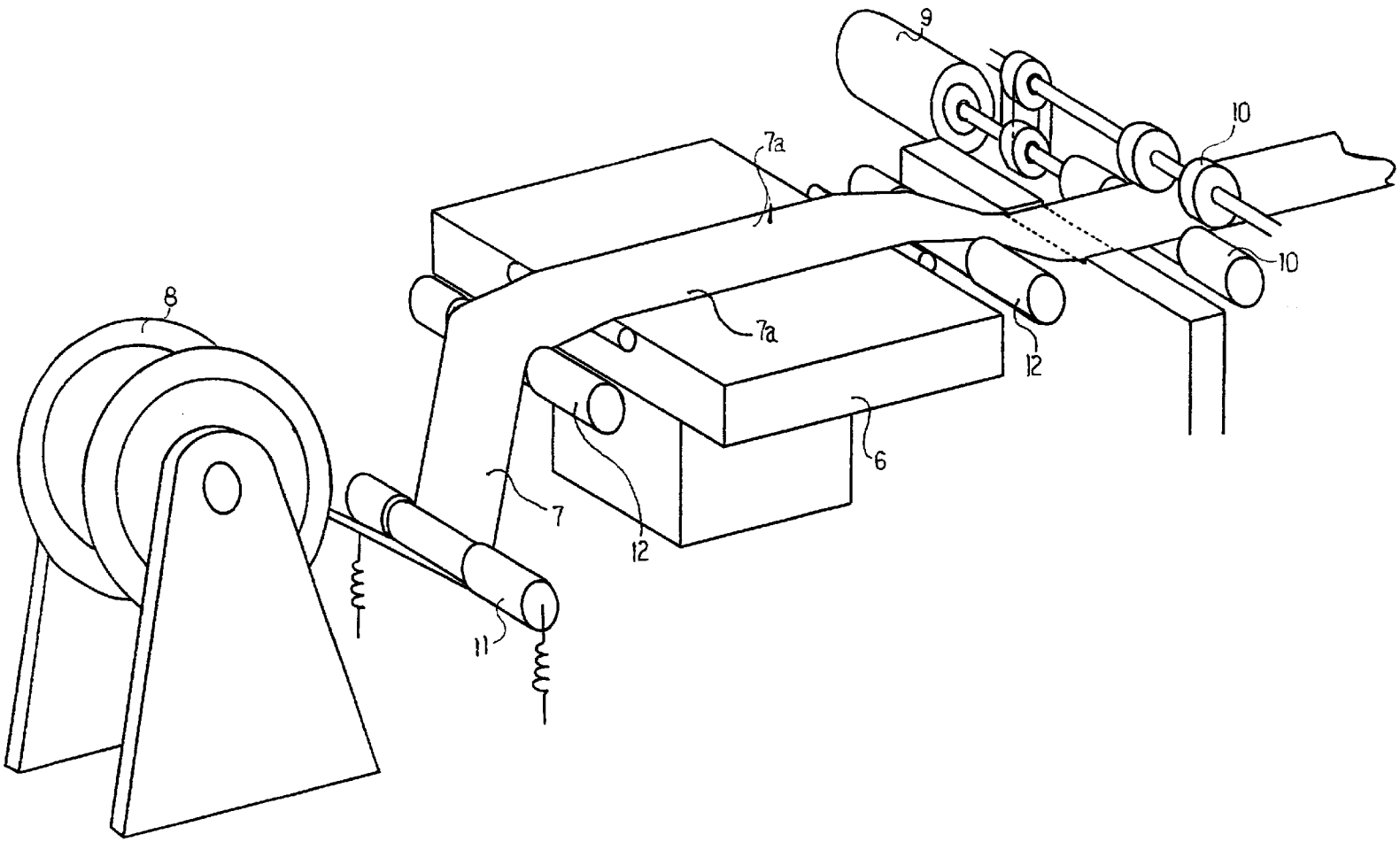
【Fig. 2】

【Fig. 3】
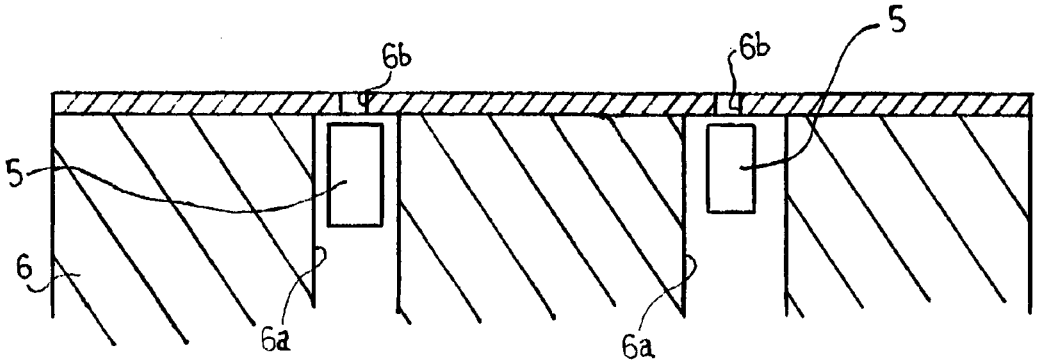

SCREEN-PRINTING APPARATUS

BACKGROUND OF THE INVENTION

This invention relates to a screen-printing apparatus.

Heretofore, a screen-printing apparatus comprises a mask and a mask support frame, a squeegee device, a printing table for supporting a material to be printed, and a camera device for imaging a position confirmation mark on the material to be printed by means of a camera so as to confirm a position of the material.

In the screen-printing apparatus, the material to be printed, which is disposed on the printing table, is positioned with respect to the mask before printing the material by means of the squeegee. This positioning operation is carried out by imaging a position confirmation mark on the material to be printed by means of a camera in the camera device to confirm a position of the material, and displacing the printing table in a right-left direction and a front-rear direction, and simultaneously rotating the squeegee device in a horizontal plane.

However, in the case where the printing table is moved to adjust the position of it, it involves a problem to rotate the printing table in a horizontal plane and it is difficult to achieve a high accuracy. In fact, there is an error more than 50 $\mu$m (microns) in the positioning operation and a misalignment will occur in a fine pattern printing. Consequently, it is impossible to obtain a high quality product.

Also, since the printing table is moved in the prior art, only a single material to be printed must be set on the printing table at every printing step. This will lower a working efficiency.

Accordingly, an object of the present invention is to provide a screen-printing apparatus in which a mask is moved to adjust a relative position between a mask and a material to be printed, thereby enhancing accuracy and making possible an application to not only a single material but also an elongate film like material to be printed, since the printing table is fixed.

SUMMARY OF THE INVENTION

In order to achieve the above object, a screen-printing apparatus of the present invention comprising a mask and a mask support frame, a squeegee device, a printing table for supporting a material to be printed, and a camera device for imaging a position confirmation mark on the material by means of a camera to confirm a position of the material, in which the printing table is fixed at a given position, the mask is displaced in a right-left direction and a front-rear direction, and is rotated in a horizontal plane in accordance with a position confirmation signal from the camera device so as to accord the positions of the mask and the material to be printed, further the mask, the mask support frame, and the squeegee device are moved up and down together at a predetermined timing at every printing step.

The material to be printed is a roll of an elongate film, drawn out from a bobbin and printed on the printing table in order. Accordingly, the present invention can greatly improve a working efficiency, since a step of setting a single material to be printed on a printing table at every printing step in the prior art can be omitted in the present invention. Also, the material to be printed is made of a transparent or semitransparent film and the camera device is arranged so that the camera is directed vertically in the printing table. Consequently, it is possible to speed up a step of confirming a position by a camera.

BRIEF DESCRIPTION OF THE DRAWINGS

FIG. 1 is a schematic diagram of a first embodiment of a screen-printing apparatus in accordance with the present invention;

FIG. 2 is a perspective view of a printing table and a material to be printed; and FIG. 3 is a partial cross section view of the printing table in a second embodiment of the screen-printing apparatus in accordance with the present invention.

DETAILED DESCRIPTION OF THE PREFERRED EMBODIMENTS

Referring now to FIGS. 1 to 3, embodiments of a screen-printing apparatus in accordance with the present invention will be explained bellow.

In FIGS. 1 and 2, a mask-moving device 3 serves to displace a mask 1 supported on a mask support frame 2 in a right-left direction (X direction) and a front-rear direction (Y direction) and to rotate the mask 1 by an angle (θ) in a horizontal plane in accordance with a position confirmation signal from a camera device 5 described below. The rotation of the mask 1 is made with a servo-motor and the like. A squeegee device 4 is disposed above the mask 1.

The mask 1, mask support frame 2, mask-moving device 3, and squeegee device 4 are moved up and down (Z direction) together at a predetermined timing at every printing step by means of a support device (not shown) and a driving device (not shown) When the mask 1 is moved down, it is placed in a printing position. When the mask 1 is moved up, it is placed in an original standby position.

The camera device 5 images a position confirmation mark on a material 7 to be printed by means of a CCD camera 5*a* to confirm a position of the material 7 to be printed. The camera device 5 moves between the mask 1 and a printing table 6 described below at every printing step to take an image. After completing this process, the camera device 5 returns to the original position. The printing table 6 has suction ports (not shown) which suck the material 7 to be printed to set it on a top surface of the table 6.

The material 7 to be printed is an elongate film such as a print-circuit substrate. The material 7 to be printed is fed onto the printing table 6 by a given length and printed thereon in order. A position confirmation mark 7*a* is formed on a surface of the material 7 to be printed. The material 7 to be printed is wound on a bobbin 8 in a rolled manner and drawn out by a given length by a pair of pinch rollers 10, 10 driven by a motor 9. In FIGS. 1 and 2, a tension roller 11, guide rollers 12, 12, and a mask-cleaning device 13 are shown.

An operation of a first embodiment of a screen-printing apparatus in accordance with the present invention will be explained below.

First, the CCD camera 5*a* of the camera device 5 take a image of the position confirmation mark 7*a* on the material 7 to be printed so as to confirm a position of the material 7 to be printed. Then, according to a signal from the camera device 5, the mask-moving device 3 displaces the mask 1 by a given distance in a right-left direction and a front-rear direction, and simultaneously rotates the mask 1 by a given angle in a horizontal plane. Thus, the position of the mask 1 is brought into accord with the position of the material 7 to be printed. The mask 1, mask support frame 2, and squeegee device 4 are moved down together. When the squeegee device 4 finishes a printing step, they are moved up together again and the mask 1 is returned to its original standby position by the mask-moving device 3. Since position adjustment is carried out by moving the mask in the embodiment, it is easy to rotate the mask 1 in the horizontal plane, thereby obtaining a higher accuracy than that in the prior art. In fact, it is possible to reduce an error to 3–12 $\mu$m.

The material 7 to be printed is drawn by a given length by means of the pair of pinch rollers 10, 10 every time when a printing step is completed, and then the material 7 to be printed is printed on the printing table 6 in order.

Next, a second embodiment of a screen-printing apparatus in accordance with the present invention will be described by referring to FIG. 3. The second embodiment differs from the first embodiment with respect to an arrangement of a camera device. That is, the camera device 5 is disposed in the printing table 6 in the second embodiment, while the camera device 5 is disposed between the mask 1 and the printing table 6 in the first embodiment.

In more detail, the camera device 5 is set in the printing table 6 so that each of the CCD cameras 5*a* is directed vertically in a receiving chamber 6*a* formed in the printing table 6. Each of the CCD cameras 5*a* takes an image of the position confirmation mark 7*a* on the material 7 to be printed through a small shooting aperture 6*b* on the printing table 6. Since the camera 5*a* takes an image from the rear side of the material 7 to be printed in the second embodiment, the material 7 to be printed should be transparent or semitransparent.

In the second embodiment, the camera device 5 need not move horizontally at every printing step, otherwise moving in the first embodiment. Accordingly, the step of confirming the position by using the camera can be carried out rapidly. Further, the space can be reduced, since it is unnecessary to reciprocate the camera device 5 in a space between the mask 1 and the printing table 6 in the second embodiment.

According to the present invention, it is possible to easily rotate the mask 1 in a horizontal plane, thereby obtaining accuracy higher than that in the prior art, since displacement of the mask 1 can adjust their positions.

In the case where the material to be printed is made of an elongate film and wound in a rolled manner so that the material can be drawn out onto and printed on the printing table in order, the step of setting a single material to be printed on the printing table at every printing step in the prior art can be eliminated and a working efficiency can be significantly improved.

Also, in the case where the material to be printed is made of a transparent or semitransparent material and the camera device is disposed in the printing table so that the camera is directed vertically, the step of confirming a position by using the camera can be effected rapidly. From the above description of the invention, a person or persons skilled in the art will perceive improvements, changes and modifications. Such improvements, changes and modifications within the skill of the art are intended to be covered by the appended claims.

The entire disclosure of Japanese Patent Application No. 2000-113018 filed on Apr. 14, 2000 including the specification, claims, drawings and summary is incorporated herein by reference in its entirety.

What is claimed is:

1. A screen-printing apparatus comprising a mask and a mask support frame, a squeegee device, a printing table for supporting a material to be printed, and a camera device for imaging a position confirmation mark of the material to be printed by means of a camera to confirm a position of the material to be printed, the printing table being fixed at a given position, the mask being displaced in a right-left direction and a front-rear direction, and being rotated in a horizontal plane in accordance with a position confirmation signal from the camera device so as to accord the positions of the mask and the material to be printed, the mask and mask support frame and the squeegee device being moved up and down together at a predetermined timing at every printing step, said camera device being disposed between said mask and said printing table so that said camera device can move in the right and left direction and the up and down direction with respect to said material to be printed independently of said mask and said printing table.

2. A screen-printing apparatus according to claim 1, wherein the material to be printed is made of an elongate film, rolled in a bobbin, drawn out and printed on the printing table in order.

3. A screen-printing apparatus comprising:

a mask;

a mask support frame carrying said mask;

a squeegee device disposed above said mask;

a printing table fixed at a predetermined position for supporting a material or substrate for receiving printed matter; and a camera device disposed between said mask and said printing table, said camera device being mounted for reciprocation in a vertical direction and a horizontal direction for imaging a position confirmation mark on said material or substrate to confirm a position of said material or substrate on said printing table, said mask being displaceable in a pair of mutually orthogonal horizontal directions and being rotatable in a horizontal plane in accordance with a position confirmation signal from said camera device so as to coordinate the positions of said mask and said material or substrate, said mask, said mask support frame, and said squeegee device being movable together in said vertical direction at a predetermined timing at every printing step, said camera device being movable independently of said mask and said printing table.

4. A screen-printing apparatus according to claim 3, wherein said material or substrate is an elongate film rolled in a bobbin and drawn out for printing on said printing table.

* * * * *